United States Patent [19]

Ogata et al.

[11] Patent Number: 4,746,885

[45] Date of Patent: May 24, 1988

[54] ELECTROMAGNETIC APPARATUS COMBINED A PAIR OF CONTACTORS INTO ONE UNIT

[75] Inventors: Haruo Ogata, Nagaokakyo; Takashi Tanaka, Takatsuki, both of Japan

[73] Assignee: Omron Tateisi Electronics, Co., Kyoto, Japan

[21] Appl. No.: 903,298

[22] Filed: Sep. 3, 1986

[30] Foreign Application Priority Data

Sep. 6, 1985 [JP] Japan ..... 60-198303

[51] Int. Cl.[4] ..... H01H 9/20; H01H 33/46

[52] U.S. Cl. ..... 335/160; 200/150 C

[58] Field of Search ..... 335/160, 159, 161; 200/50 C

[56] References Cited

U.S. PATENT DOCUMENTS 4,356,363 10/1982 Harbauer et al. ..... 335/161

4,506,245 3/1985 Lerude et al. ..... 335/160

*Primary Examiner*—Harold Broome

*Attorney, Agent, or Firm*—Wegner & Bretschneider

[57] ABSTRACT

An electromagnetic apparatus combined a pair of contactors into one unit is provided with an interlocking mechanism for ensuring the alternative operations between the contactors, the interlocking mechanism including a pair of interlock levers each of which the end is rotatably inserted into an engaging groove provided in an element of the respective contactor which is moved to open and close a contact mechanism of the contactor, whereby the engagement between the end of interlock lever and the engaging groove of movable element can be provided with enough strength and can be easily assembled.

3 Claims, 9 Drawing Sheets

ELECTROMAGNETIC APPARATUS COMBINED A PAIR OF CONTACTORS INTO ONE UNIT

BACKGROUND OF THE INVENTION

The present invention generally relates to an electromagnetic apparatus consisting of a pair of contactors, and, more particularly, to an interlocking mechanism provided within the electromagnetic apparatus for controlling the alternative operations of the pair of contactors.

Generally, an electromagnetic apparatus is adapted to open and/or close a fixed point of contact by a movable insulation stand having a moving point of contact through a polar contact reciprocating in accordance with the excitation or de-magnetization of an electromagnetic device, said electromagnetic device, polar contact, movable insulation stand and contact mechanism including the fixed point and moving point of contact being accommodated in series within a casing. Also, there has been proposed an electromagnetic apparatus consisting of a pair of contactors each having the same arrangement as that of the above electromagnetic apparatus, with the casing of one contactor being combined in parallel connection with the casing of the other contactor in one unit. In the electromagnetic apparatus combining two contactors within one casing, an interlocking mechanism is provided within the casing to control the contactors in such a manner that, when either one of the contactors is at the state of operating, the other of the contactors is interlocked not to operate by any means. Conventionally, such an interlocking mechanism is provided with a pair of interlock levers each pivotally connected with the corresponding movable insulation stand by means of a pin or shaft and is so arranged to make an interference with the other that the contactors are adapted to operate one by one so as to prohibit the simultaneous operation with each other. However, the interlocking mechanism of the above type has disadvantages such that the connecting means of pin or shaft is rendered to design to have a small dimension due to existing a space problem of the casing, and to assemble with a small clearance provided between the pin or shaft and a hole provided on the lever to be fitted with the pin or shaft in order to maintain the precise operation of the interlocking mechanism, thereby to cause not to provide enough strength for the interlocking mechanism, and not to facilitate the assembling of the interlocking mechanism.

SUMMARY OF THE INVENTION

Accordingly, an essential object of the present invention is to provide an electromagnetic apparatus combining two contactors into one unit of the type as referred to above, which can eliminate disadvantages inherent in the conventional one, and in which the interlocking mechanism for ensuring an alternative operation of contactors can be provided with enough strength and can be easily assembled without causing any troubles.

According to the present invention, an electromagnetic apparatus comprising a casing having two compartments, a pair of electromagnetic contactors each accommodated within the respective compartment of the casing and provided with a set of an electromagnetic device, a polar contact, a movable insulation stand, and a contact mechanism including a fixed contact and a movable contact, an arrangement which opens and clsoes the fixed contact by means of the movable contact provided in the movable insulation stand through the movable polar member to be reciprocating in accordance with the excitation and de-magnetization of the electromagnetic device, and an interlocking mechansim provided in the casing with a pair of interlock levers of which each end is rotatively inserted into the corresponding engaging groove provided in the respective movable insulation stand, the pair of interlock levers being arranged to make an interference with each other so that the pair of contactors are adapted to operate one by one under prohibiting the simultaneous operations of the contactors.

BRIEF DESCRIPTION OF THE DRAWINGS

These and other objects and features of the present invention will become apparent from the following description taken in conjunction with the preferred embodiment thereof with reference to the accompanying drawings, in which.

DESCRIPTION OF THE PREFERRED EMBODIMENTS

Figure 1:
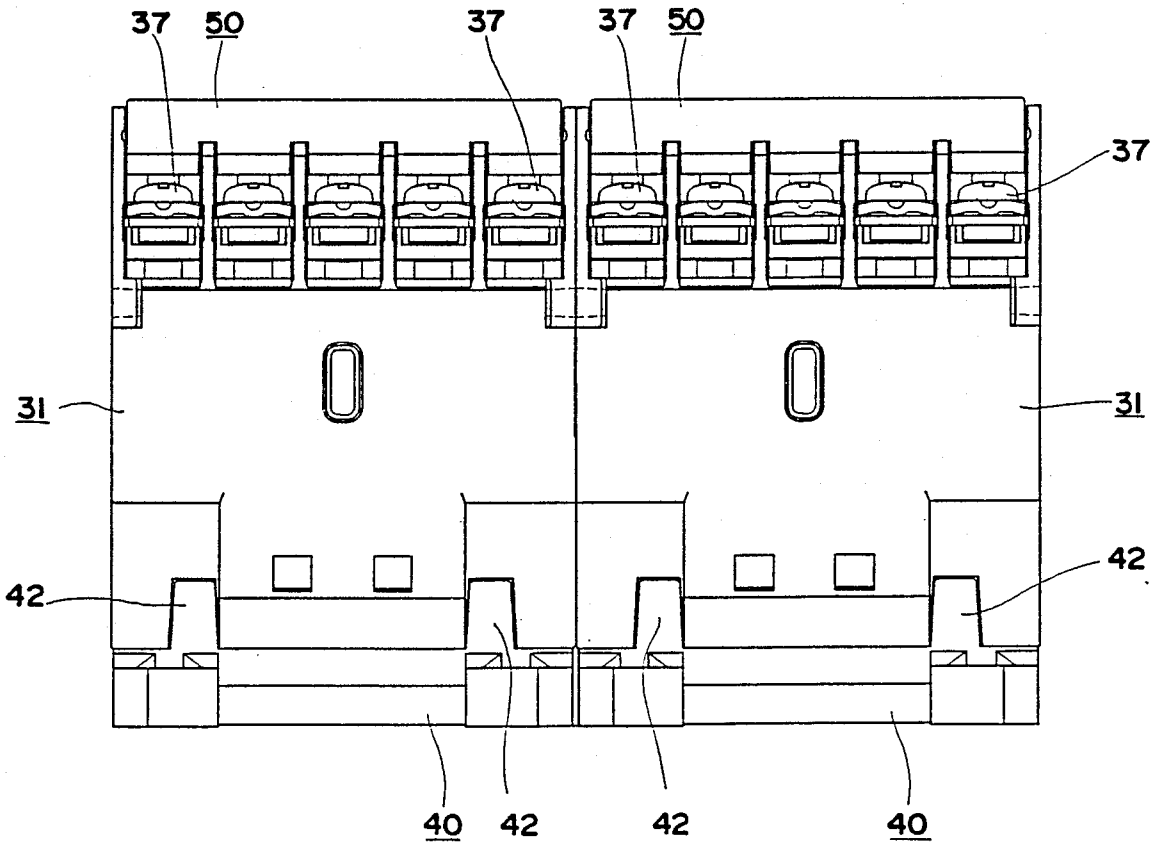
FIG. 1 is a front view of an electromagnetic apparatus, which consists of a pair of contactors, according to a first embodiment of the present invention.
Figure 2:
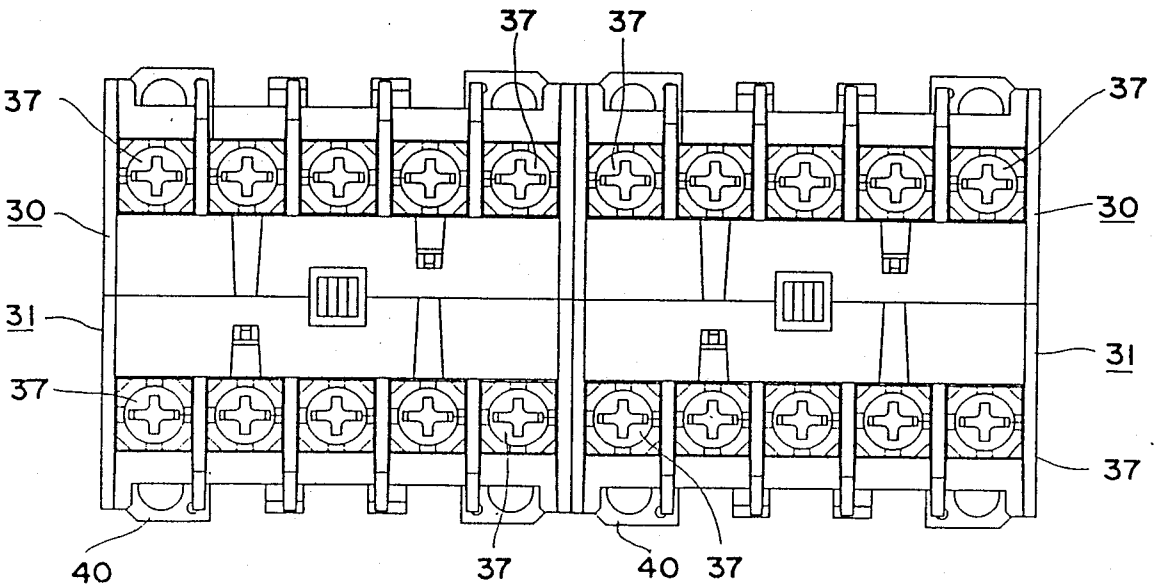
FIG. 2 is a plan view of the electromagnetic apparatus of FIG. 1.
Figure 3:
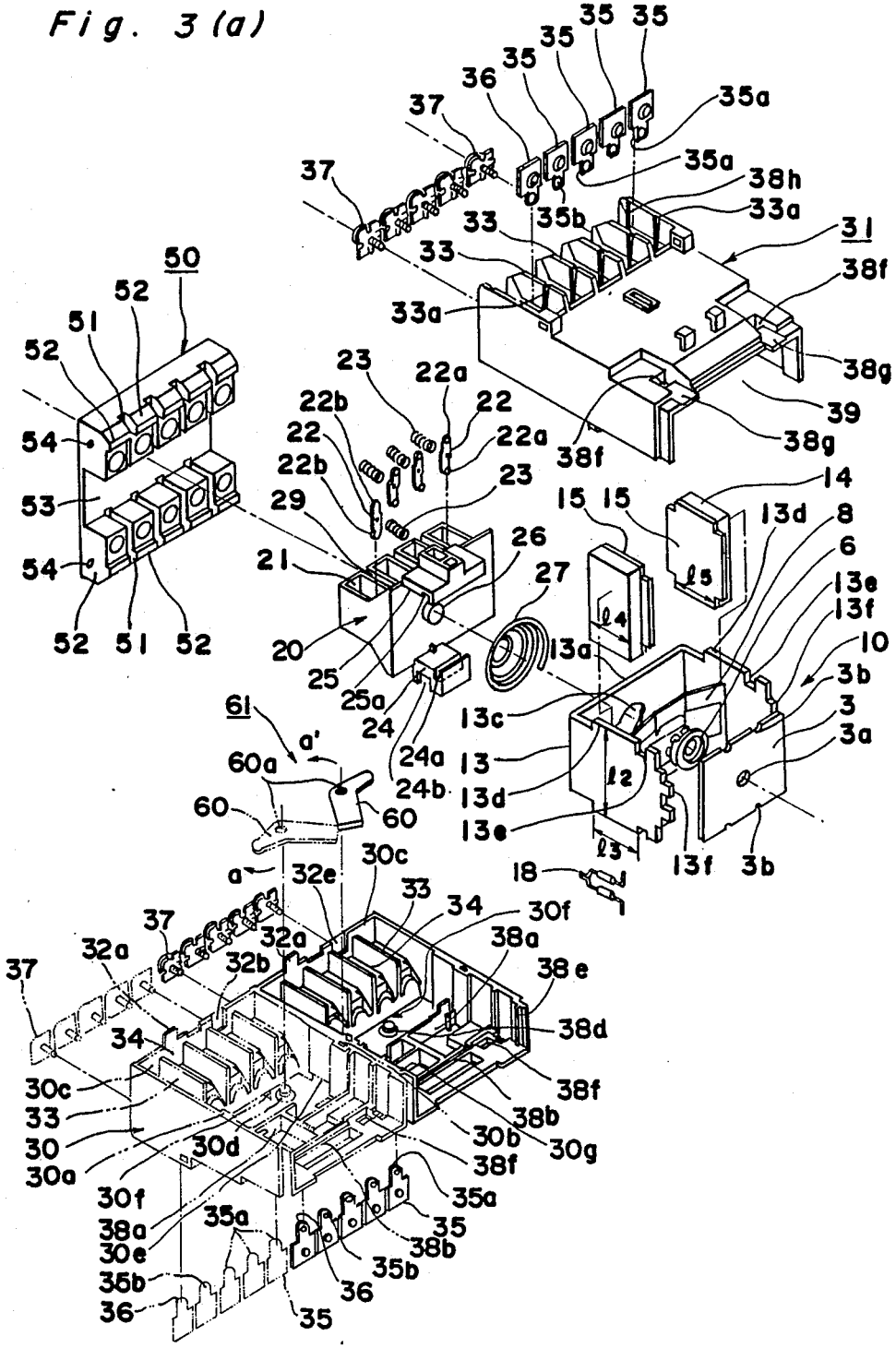
FIGS. 3(*a*) and 3(*b*) are exploded perspective views, each showing all parts of a half part, that is, one contactor to be assembled into the electromagnetic apparatus of FIG. 1.
Figure 3B:
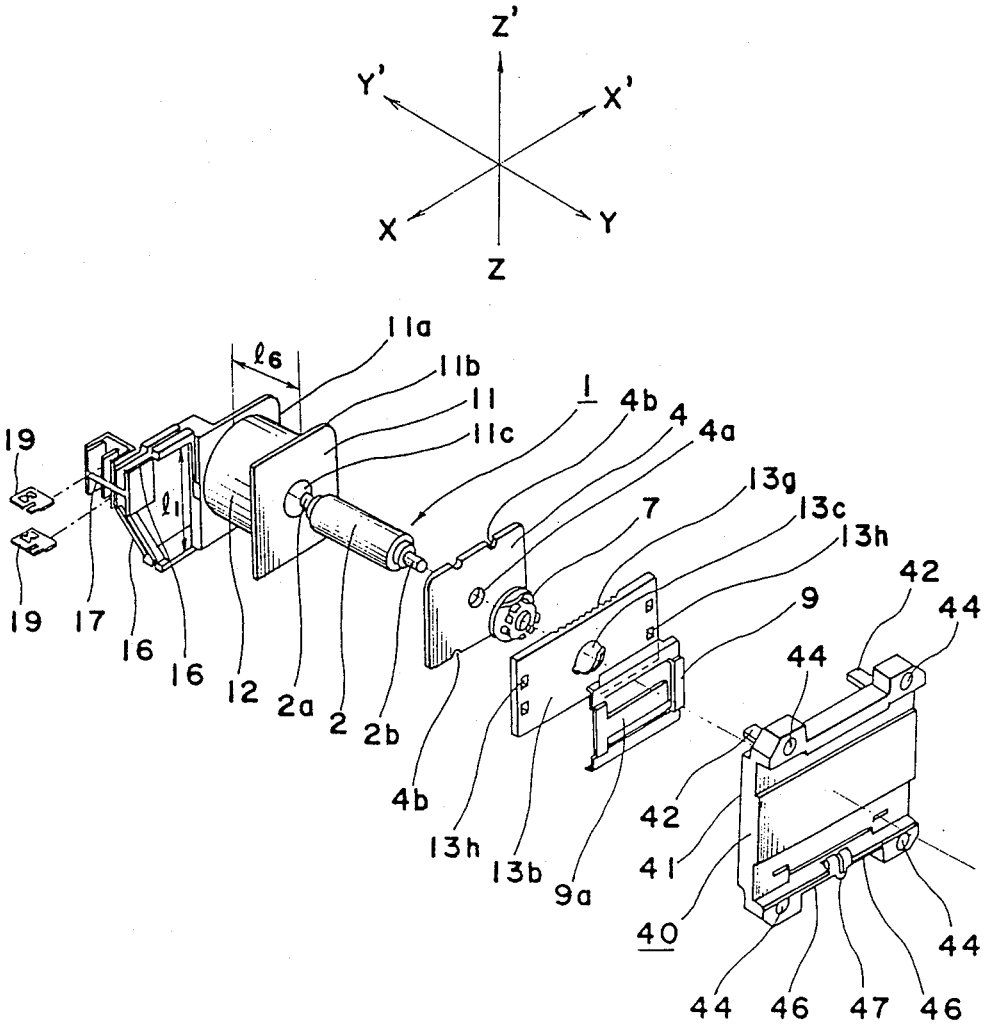
Figure 4:
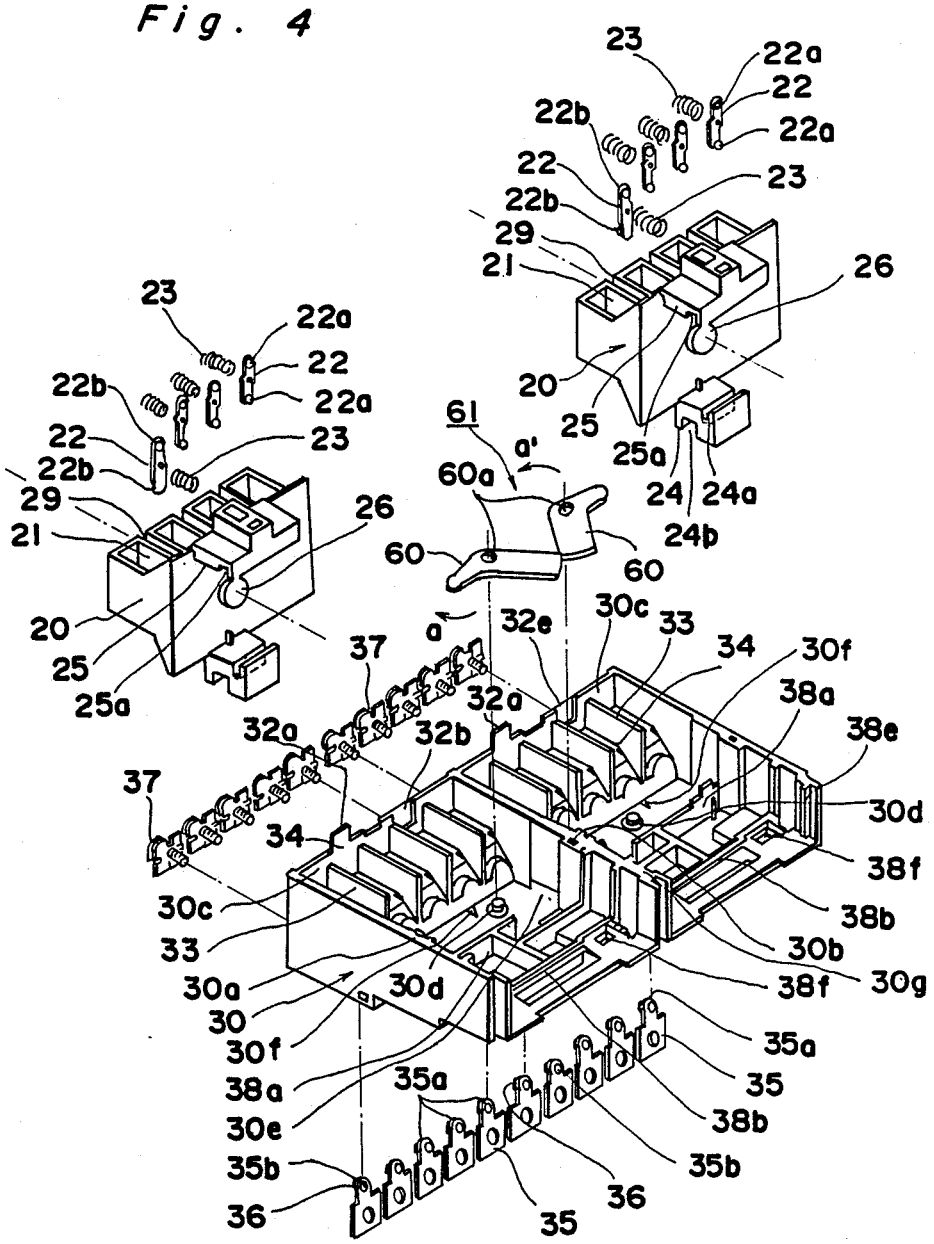
FIG. 4 is an exploded perspective view, on an enlarged scale, showing an essential portion of the electromagnetic apparatus of FIG. 1.
Figure 5:
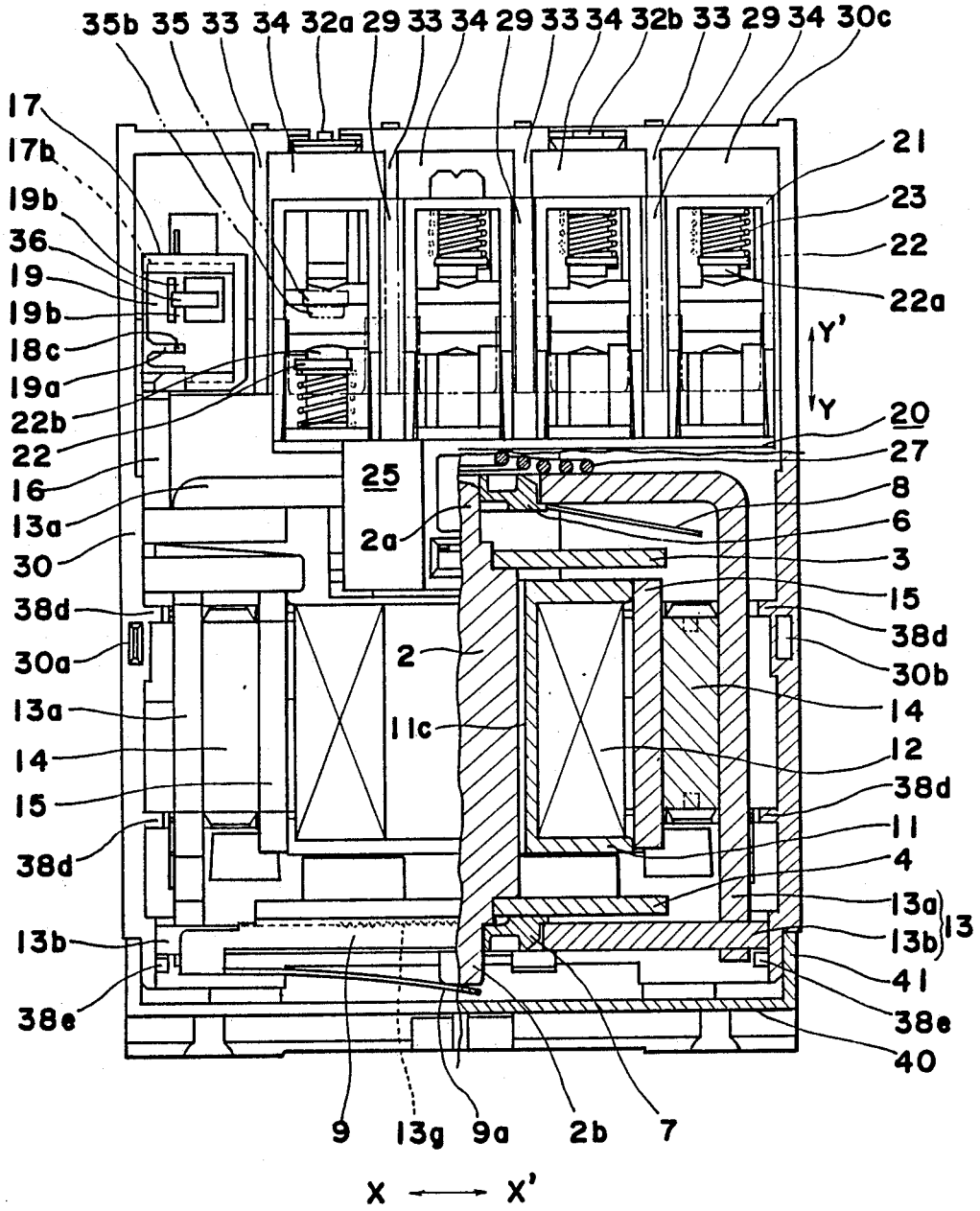
FIG. 5 is a front view, on an enlarged scale, showing one contactor of the electromagnetic apparatus of FIG. 1, after removing the front side casing to show the electromagnetic device in a cross-section being partly broken away.

Before the description of the present invention proceeds, it is to be noted that like parts are designated by like reference numerals throughout the accompanying drawings. Also, it is to be noted that in the accompanying drawings, the upward direction of the embodiment of the present invention is shown with Y', and the downward direction is shown with Y.

FIGS. 1 to 8 show an electromagnetic apparatus, according to a first embodiment of the present invention, comprising a pair of contactors each including a polar contact 1, an electromagnetic device 10, a movable insulation stand 20, a side casing 31, a bottom casing 40, a terminal protection covering 50, and a half part of a common casing 30 having a pair of left and right side sections, each section to be mounted with said polar contact 1, electromagnetic device 10, movable insulation stand, 20 side casing 31, bottom casing 40, terminal protection covering 50 therein to provide one of the contactors and an interlocking mechanism 61 being provided within the common casing 30 to control the alternative operations of the pair of contactors.

The electromagnetic device 10 is comprised of a spool 11 having flanges 11*a* and 11*b* at opposite ends thereof, a coil 12 wound around the drum of the spool 11, an outer frame yoke 13 having a generally square cross section and surrounding the spool 11, permanent magnetic 14 and 14 intervened between the outer frame yoke 13 and the spool 11, and inner plate yokes 15 and 15.

Figure 6:
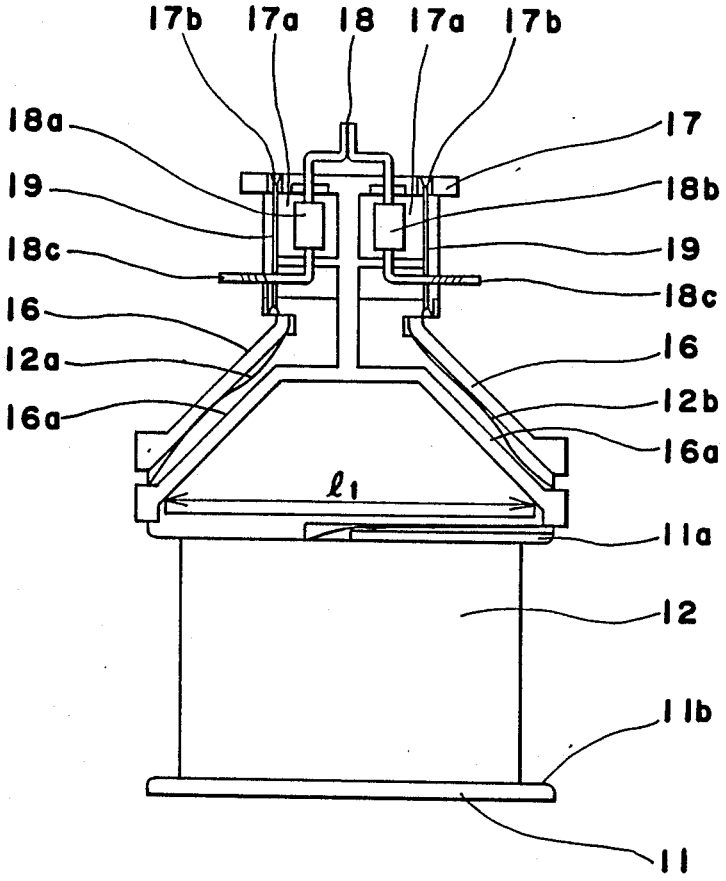
FIG. 6 is a front view of a spool of the electromagnetic apparatus of FIG. 5.

Referring to FIG. 6, the spool 11 is formed with a central hole 11*c* at the drum thereof, within which hole 11c the movable iron core 2 can reciprocate, and at the same time, the spool 11 has a pair of arm portions 16 and 16 extending from a corner of the flange 11*a*, and a holder member 17 for the relay terminal which connects the ends of the arm portions 16 and 16 with each other.

Guide grooves 16*a* and 16*a* are formed in the arm portions 16 and 16 so as to guide the ends 12*a* and 12*b* of the coil 12. In the holder member 17, there are formed recesses 17*a* and 17*a* which receive a surge absorption element 18 in which a diode 18*a* and a resistance 18*b* are connected in series, and also grooves 17*b* and 17*b* into which are pressed relay terminals 19 and 19.

The relay terminals 19 and 19 are made by punching out by a press. The relay terminal 19 includes a notched groove 19*a* into which a leading wire 18*c* of the surge absorption element 18 is pressed, and a pair of opposed tongue pieces 19*b* and 19*b* into which a coil terminal 36 is pressed for electric connection.

The outer frame yoke 13 consists of a yoke 13*a* bent in a generally ⊐-shape and a plate-like yoke 13*b*. The yokes 13*a* and 13*b* have bearing holes 13*c* and 13*c* respectively formed in the center thereof so that the bearings 6 and 7 are fixedly fitted into the holes 13*c* and 13*c*.

Moreover, at the opposite side walls, the bent yoke 13*a* is formed with projections 13*d* and 13*d* for positioning opposed to each other, notched portions 13*e* and 13*e* for positioning and protrusions 13*f* and 13*f* for fitting. Meanwhile, at the brim of the inner side surface of the plate-like yoke 13*b* in the longitudinal direction, there are provided a zigzag 13*g* with small consecutive notches and holes 13*h* and 13*h* for fitting.

Since this zigzag 13*g* is engaged with a small projection (not shown) formed in the inner side surface of the sliding adjustment spring 9, delicate adjustment can be easily performed.

Therefore, when the polar contact 1 is to be installed into the electromagnetic device 10, first the relay terminals 19 and 19 are respectively pressed into the grooves 17*b* and 17*b* in the holder member 17 to be fixed. Thereafter, the surge absorption element 18 is put into the recesses 17*a* and 17*a* of the holder member 17, and at the same time the leading wires 18*c* and 18*c* are protrudingly pressed into the notched grooves 19*a* and 19*a*.

Then, after the ends 12*a* and 12*b* of the coil 12 wound around the trunk of the spool 11 are drawn out along the guide grooves 16*a* and 16*a* of the arm portions 16 and 16 to be tied up with the leading wires 18*c* and 18*c* of the surge absorption element 18, the coil 12, the surge absorption element 18 and the relay terminal 19 are electrically connected with one another through soldering.

After the movable iron core 2 is inserted through the central hole 11*c* in the trunk of the spool 11, while the shaft supporting portions 2*a* and 2*b* at the opposite ends of the iron core 2 are respectively protrudingly fitted into the holes 3*a* and 4*a*, the iron core 2 is fixedly caulked.

Next, the bearing 6 is fitted into and secured to the bearing hole 13*c* of the bent yoke 13*a*, so that the operational spring 8 is held between the bent yoke 13*a* and the bearing 6. On the other hand, the bearing 7 is fitted into and secured to the bearing hole 13*c* of the plate-like yoke 13*b*.

It is to be noted here that according to the present embodiment, not only the positioning accuracy of the movable iron core is considerably improved, and the reciprocating movement of the movable iron core 2 is rendered smooth, since the bearings 6 and 7 are fixedly fitted into the beating hole 13*c*.

Then, an end of the side wall of the bent yoke 13*a* (the width l2) is passed through between the arm portions 16 and 16 (the maximum opposed distance l1: $l2<l1$). Thereafter, the shaft supporting portion 2*a* is inserted through the bearing 6, and the other shaft supporting portion 2*b* is inserted through the bearing 7 fixed to the plate-like yoke 13*b*. Simultaneously, the projected portions 13*f* and 13*f* of the bent yoke 13*a* are fitted into holes 13*h* and 13*h* of the plate-like yoke 13*b* to be caulked. Thus, the electromagnetic device 10 is completely assembled.

In the movable insulation stand 20, a contacting element 22 having movable points of contact 22*a* and 22*b*, and a contact coil spring 23 are included in each of four holder members 21 which are placed in parallel relation to each other with a slit 29 therebetween. In addition, the movable insulation stand 20 has embracing members 24 and 25 which protrude downwards from the opposite side faces. These embracing members 24 and 25 are respectively formed with sliding grooves 24*a* and 25*a* which can be slidingly pressed into the opposite side portions of the movable iron piece 3 over the outer frame yoke 13. A small projection (not shown) is provided in the respective inner side surface of the grooves 24*a* and 25*a* so as to be engaged with the notched portions 3*b* and 3*b* of the iron piece 3. Owing to this small projection, the movable insulation stand 20 can be mounted in the electromagnetic device 10 correctly and speedily. The embracing member 24 is also provided with an engaging groove 24*b* for engaging with the end portion 60*b* of an interlocking lever 60 as described later.

The movable insulation stand 20 has a projection 26 formed at the central part on the lower surface in the Y direction. The projection has approximately the same diameter (l8) as the inner diameter of a conical coiled spring 27 at the side of smaller diameter, and the same height as the diameter of a spring wire. The projection 26 is formed with a pair of opposing engagement portions 26*a* and 26*a* at the front end thereof.

The conical coil spring 27 is mounted in the projection 26 in such a manner that the coil spring 27 is mounted directly by pressing the side of the smaller diameter to engage the inner surface of the spring with the engaging portion 26*a*.

The thus-mounted coil spring 27 never slips off from the movable insulation stand 20, even in the case that the movable insulation stand with the coil spring 27 mounted therein is turned sideways or upside down. Since the projection 26*a* has the same height as the diameter of the coil, the coiled spring 27 can be rendered expansible with much room, which fact is nevertheless not an obstacle to the mountings.

When the movable insulation stand 20 is to be installed in the electromagnetic device 10, the sliding grooves 24*a* and 25*a* are positioned with respect to the movable iron piece 3 from the lateral direction of the electromagnetic device 10. Thereafter, the small projections (not shown) of the sliding grooves 24*a* and 25*a* are pushed until they are engaged with the notches 3*b* and 3*b*, thus making one unit. At this time, since there is a fear that the lower end of the conical coils spring 27 in the Y direction should be engaged with the shaft supporting portion 2*a* protruding out of the outer frame yoke 13, the movable insulation stand 20 had better be pressed while the movable iron core 2 is moved a little in the Y direction. Subsequently, after the sliding adjustment spring 9 is slidingly pressed into the opposite ends of the plate-like yoke 13*b* in the longitudinal direction, the inner components are completely assembled. The pair of side casings 31 have the same configurations with each other which are symmetrical to the configurations of both side sections of the common casing 30. One side casing 31 is engaged with the left side section of the common casing 30 upon overlapping their respective openings together, and the other side casing 31 is engaged with the right side section of the common casing 30 upon overlapping their respective openings together to provide a complete, whole casing. In the casings 30 and 31, a projection 30*a* for positioning is designed to be fitted in a recess 30*b* for positioning. Further, an engaging claw 32*a* and an engaging recess 32*b* provided respectively in the upper end part 30*c* of the casing 30 are designed to be engaged with each other. When the projection 30*a* is fitted in the recess 30*b* and the engaging claw 32*a* is engaged with the recess 32*b*, and both are integrally formed into one unit, the side casings 30 and 31 make a box-like configuration, with a mouth at the side of the Y direction. On the other hand, at the side of the Y′ direction of the casing, a terminal receiving room 34 is formed which is divided one from another by an insulative wall 33 orthogonal to the upper end part 30*c*.

A fixed terminal 35 secured to fixed points of contact 35*a* and 35*b* and a coiled terminal 36 are arranged to be passed into this terminal receiving room 34 along a lateral groove 33*a* formed in the insulative wall 33 so as to be fixed by screw terminals 37 and 37. It is needless to say that the screw terminals 37 and 37 can be electrically connected to an external leading terminal (not shown).

Each of the side casings 30 and 31 is further provided with a pair of walls 38*a* and 38*b* parallelly projected on the inner bottom surface. The distance between the inner side faces of the walls 38*a* and 38*b* is equal to the width l3 of the projections 13*d* and 13*d* of the bent yoke 13*b*, and at the same time, equal to the width l4 of the permanent magnets 14 and 14, and the minimum width l5 of the inner plate yokes 15 and 15. Further, the distance between the outer side faces of the walls 38*a* and 38*b* is equal to the distance l6 between the inner side faces of the flanges 11*a* and 11*b* of the spool 11.

Each of the walls 38*a* and 38*b* has a stepped portion 38*c* (the one wall 38*a* is not shown) provided at the center of the outer side surface so that the spool 11 is positioned in the direction of the Z—Z′ axis.

In the meantime, a pair of drills 38*d* and 38*d* are formed in the inner side faces of the side casings 30*a* and 31 for positioning the outer frame yoke 13 in the direction of the X—X′ axis. Further, a guide projection 38*e* is provided there for guiding the outer frame yoke 13.

Therefore, in order to install the electromagnetic device 10 integrally formed with the movable insulation stand 20 into the side casings 30 and 31, first, the outer frame yoke 13 is fixedly positioned by the guide projection 38*e* formed in the side casing 30. And then, the outer frame yoke 13 is pressed in the Z direction along the drills 38*d* and 38*d*, with the projected portion 13*d* being fitted in between the walls 38*a* and 38*b*, and the notched portion 13*e* being fitted in the wall 38*b*. Thus, the outer frame yoke 13 is fixedly positioned both in the direction of the X—X′ axis and in the direction of the Y—Y′ axis. Then, the spool 11 is arranged in such a manner that the walls 38*a* and 38*b* are held between the inner side faces of the flanges 11*a* and 11*b*, and consequently, the spool 11 is fixedly positioned in the direction of the Y—Y′ axis. At the same time, the side ends of the flanges 11*a* and 11*b* in the Z direction are brought into contact with the stepped portions 38*c*.

Concurrently with this, the coiled terminal 36 which protrudes inwardly of the side casing 30 is pressed in between the tongue elements 19*b* and 19*b* of the relay terminal 19 fixedly pressed in the holder part 17 for electric connection. Moreover, the slit 29 of the movable insulation stand 20 is fitted in the insulative wall 33 protruding inwardly of the side casing 30, so that the movable point of contact 35*a* and the fixed point of contact 22*a* are arranged to be opposite to each other, and likewise, the movable point of contact 35*b* and the fixed point of the contact 22*b* are arranged to be opposed to each other.

Next, along the inner side surface of the outer frame yoke 13, the permanent magnet 14 and the lower end of the inner plate yoke 15 are successively pushed in between the walls 38*a* and 38*b*. Thus, the spool 11 is fixedly positioned in the direction of the X—X′ axis.

At this time, the opposite end faces of the yoke 15 in the direction of the Y—Y′ axis are so opposed, with a predetermined interval, as to be able to be in touch with the inner side faces of the movable iron pieces 3 and 4, respectively.

Thereafter, when the remaining side casing 31 is formed into one unit with the side casing 30 through the engaging claw 32*a*, the engaging recess 32*b*, the projection 30*a* and the recess 30*b*, the spool 11, the outer frame yoke 13, the permanent magnet 14 and the inner plate yoke 15 are all fixedly positioned in the direction of the Z—Z′ axis.

The adjustment spring 9 slidingly pressed into the plate-like yoke 13*b* is exposed from the mouth (not shown) formed when the casings 30 and 31 are formed into one unit, and therefore, if the spring 9 is slid to change the valid distance of the leaf spring 9*a* to be in touch with the end face of the shaft supporting portion 2*b*, the restoring voltage can be adjusted.

In the above-described embodiment, since the side casings 30 and 31 are designed to be separable in the moving direction of the polar contact, the positioning accuracy in the moving direction of the polar contact can be enhanced. Therefore, the contact pressure can be less variable, improving the working characteristics.

A bottom casing 40 having the configuration of a flat plane to cover the mouth (not shown) of the side casings 30 and 31 has an annular projection 41 provided in the upper surface thereof. The annular projection 41 surrounds the above-described mouth formed when the casings 30 and 31 are integrally formed. In addition, the bottom casing 40 is formed with an engaging claw 42 projecting upwards so as to be engaged with an engaging hole 38*f* at the lower part of the side casings 30 and 31. Moreover, there are formed a groove for mounting a rail at the opposite sides in the longitudinal direction of the lower surface of the bottom casing 40 at the side of the Y direction. Rail engaging pieces 46 and 46 are connected to a thin portion 47 in a generally U-shape. At each of the four corners of the bottom casing 40, a hole 44 is formed for mounting the casing onto the surface of the panel plate.

Accordingly, it is enough to mount the casing 40 that the bottom casing 40 is pressed so as engage the engaging claw 42 with the engaging hole 38*f* after the engaging claw 42 is fixedly positioned along the guide grooves 38*g*.

A terminal protection covering 50 is provided, at the center of the lower surface in the longitudinal direction at the side of the Y direction, with a positioning groove 53 to be fitted with the upper end part 30*c* of the side casings 30 and 31. Moreover, a row of terminal protectors 52 is arranged at the opposite sides of the lower surface in the longitudinal direction of the covering 50 in parallel relation to each other. The terminal protectors are separated from each other by a slit 51 and are able to be fitted with the insulative wall 33 of the side casings 30 and 31. There are small semi-spherical projections 54 and 54 at the opposite side ends of the terminal protection covering 50 orthogonal to the X—X′ axis, which projections are fitted with fitting grooves 38*h* formed in the inner side surface of the side casings 30 and 31.

Therefore, in assembling, after the positioning groove 53 and the slit 51 are fitted into the upper end part 30*c* and the insulative wall 33 respectively, they should be pressed down from above so that the small projection 54 is fitted into the groove 38*h*.

Figure 7:
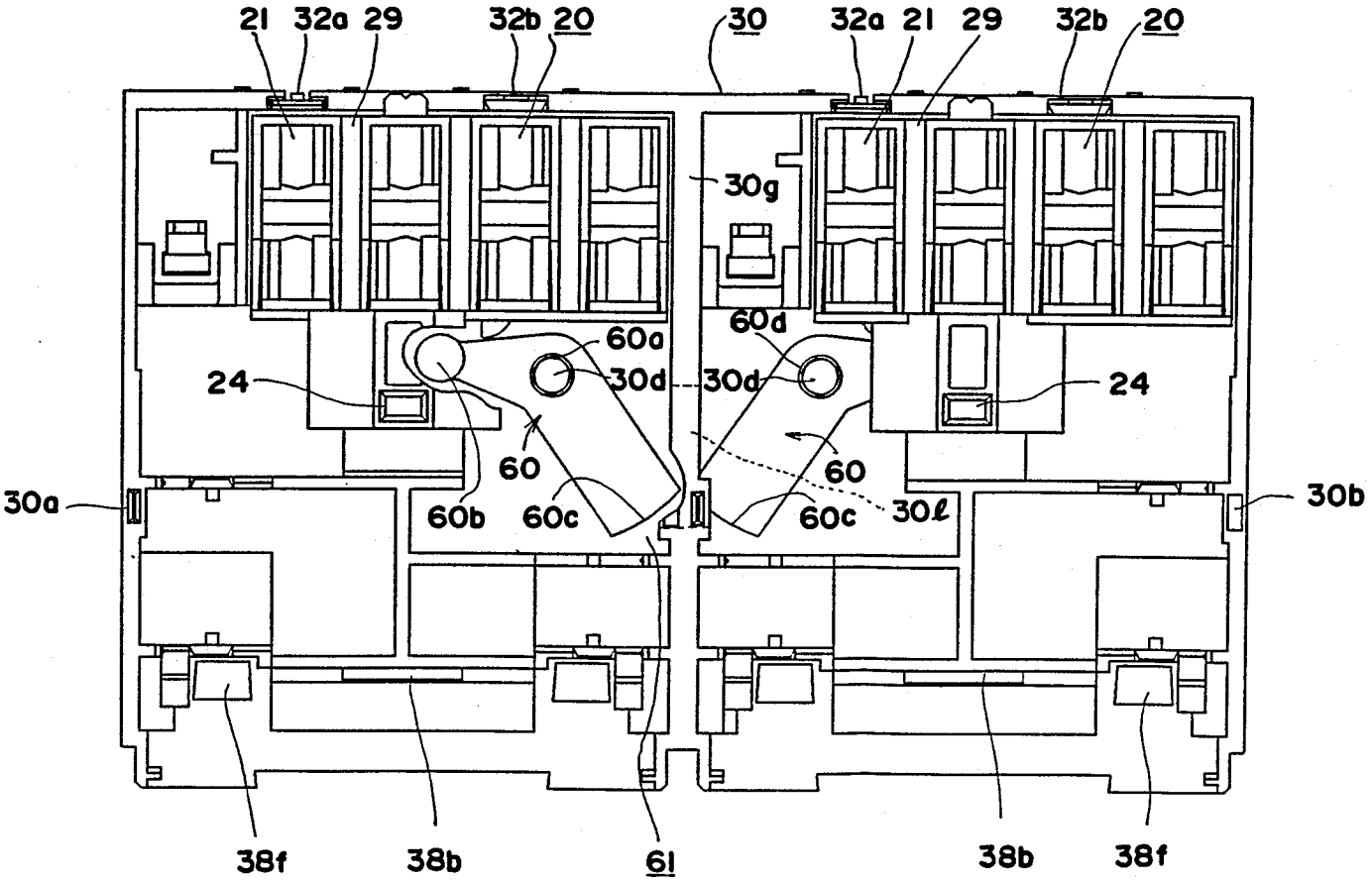
FIG. 7 is a front view, with a partial portion being broken away, showing the pair of contactors of the electromagnetic apparatus of FIG. 1, after removing the respective front side casing to show interlocking mechanisms provided therein.

An interlocking mechanism 61 is provided across the pair of contactors to ensure the alternative operations between the contactors, and comprises a pair of interlock levers 60, 60 each provided within the respective side section of the common casing 30 in engagement with the corresponding embracing member 24 of the movable insulating stand 20 provided in each of the contactors. The interlock levers 60 have configurations symmetrical to each other, formed by metal plate, as shown in FIG. 7. Each of the interlock levers 60 is formed substantially of a reversed L shape like as a bell crank, the center, bending portion 60*a* of which being mounted rotatably on a projected pin 30*d* provided at the inner surface of the side sections of the common casing 30, while the upper end 60*b* of which is engaged inserted into the engaging groove 24*b* of the movable insulation stand 24 to move together. The upper end 60*b* of interlock lever 60 is formed of a round shape which is slidable along the upper and lower surfaces of the engaging groove 24*a* of the movable insulation stand 20 when the interlock lever 60 is rotating around the projected pin 30*d* in accordance with the vertical movement of the movable insulation stand 20. When the movable insulation stand 20 is moved from the returned position R to the operation position 0, the interlock lever 60 is rendered to rotate from the lower position L to the upper position U, and vice-versa. Also, the lower end 60*c* of interlock lever 30 is formed of a circular shape having a radius of curvature to the projected pin 30*d*, and is placed at the lower position vis-a-vis with the lower end 60*c* of the other interlock lever placed at the lower position through a passage 30*e* provided on the central partition wall 30*g* of common casing 30 when both of the movable insulation stands are not actuated at their returned positions R. The passage 30*l* is opened passing through the both side sections of the common casing 30, into which both of the lower ends 60*c* of interlock levers 60 pivotally provided within the both side sections of the common casing are freely moved to pass through from one side to the other side and vice-versa. For instance, when the one movable insulation stand 20 is actuated to move from the returned position R to the operation position 0 upon exciting of the coil 12, the corresponding interlock lever 60 is simultaneously rotated around the projected pin 30*d* by the engagement between the upper end 60*b* of the interlock lever 60 and the engaging groove 24*b* of the embracing member 24 to move the lower end 60*c* of interlock lever from the lower position L to the upper position U upon passing through the passage 30*l* of the central partition wall 30*g* of common casing 30, regardless of the other interlock lever 60 of which the lower end 60*c* is stationarily positioned at the lower position L not to insert into the passage 30*l* under the non-actuation of the other movable insulation stand 20. In other words, when both the interlock levers 60 are not rotated by the movable insulation stands 20 with the lower ends 60*c* of the interlock levers 60 being stationary at their respective lower positions, L, either one of the interlock levers 60 can be freely moved from the lower position L to the upper position U in cooperation with the movement of the corresponding movable insulation stand 20 passing freely through the passing 30*l* of the central partition wall 30*g* with no relationship to the other interlock lever 60. But, if and when the one of the interlock levers 60 is positioned at the rotated position U upon the actuation of the movable insulation stand 20 to place its lower end 60*c* at the upper position U being passed through the passage 30*l* of central partition wall 30*g*, the other of the interlock levers 60 is interfering with the one of the interlock levers so as not to move into the passage 30*l* of the central partition wall 30*g* under the prevention by the lower end 60*c* of the one of the interlock levers 60 against the rotational movement of the lower end 60*c* of the other of the interlock levers 60.

Accordingly, with the arrangement of the interlocking mechanism, both the movable insulation stands 20 cannot moved together from the returned positions R to the operation positions 0 at the same time, resulting in that the alternative operations of the contactors can be ensured properly.

Figure 8A:
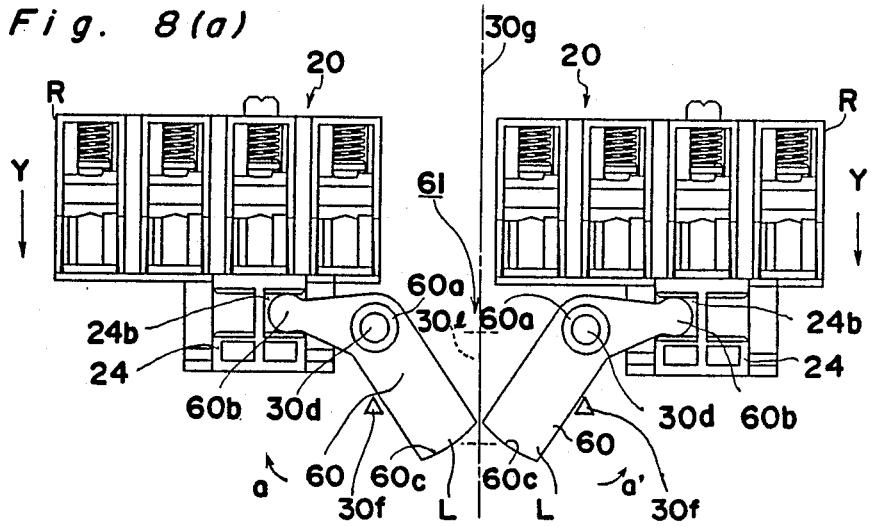
FIGS. 8(*a*) to 8(*c*) are explanatory front views each showing the interlocking mechanisms of FIG. 7 for the purpose of illustrating the operation of the interlock mechanism.
Figure 8B:
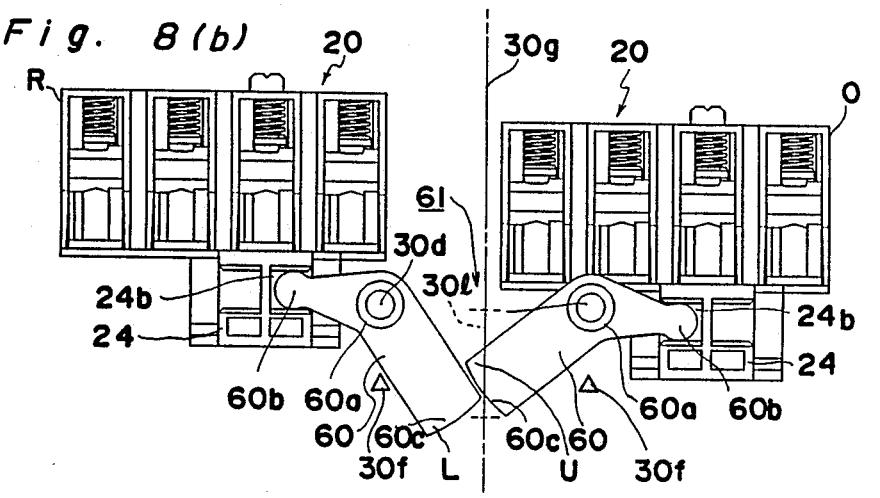
Figure 8C:
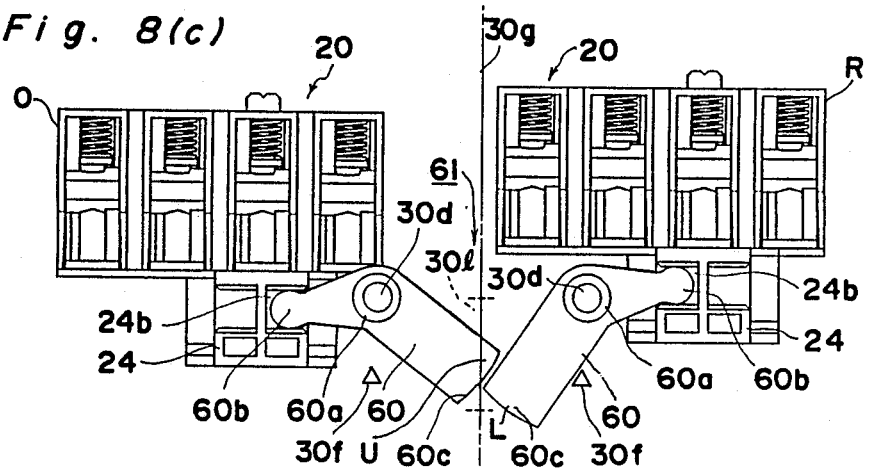

The pair of interlock levers 60 are mounted respectively on the projected pins 30*d* of the side sections of the common casing 30 before assembling the electromagnetic devices 10, movable insulation stands 20 within the respective side sections of the common casing 30, under the arrangement of preventing from rotating toward the directions shown with arrows a, a′ in FIG. 8(*a*) by stoppers 30*f* provided on the inner surfaces of the both side sections of the common casing 30.

Since the both outer edges of upper and lower surfaces of the engaging grooves 24*b* provided on the embracing members 24 are chamfered to form beveling portions at the assembling of interlock levers 60, the upper ends 60*b* of the interlock levers 60 are easily inserted into the engaging grooves 24 of embracing members 24 at the right positions under the guidance of the beveling portions of the engaging grooves 24*b* even in the case of the interlock levers 60 being slightly slipped or twisted from the right positions.

The operation of the electromagnetic device according to the present embodiment will now be described hereinbelow.

When the coil 12 is not excited, the movable insulative stand 20 is in the returned position in the Y' direction because of the spring force of the conical coil spring 27 and the adjustment spring 9. At the same time, the movable point of contact 22*a* is separated away from the fixed point of contact 35*a*, while the movable point of contact 22*b* is closing the fixed point of contact 35*b*. At this time, the pair of interlock levers are stationary at their lower positions, as shown in FIG. 8(*a*), without making any troubles to interfere with each other.

Then, when the coil 12 positioned at the left side of the common casing 30 is excited to move the polar contact 1 in the Y direction, the movable insulation stand 20 is displaced in the Y direction through the embracing members 24 and 25. In consequence, the movable point of contact 22*a* closes the fixed point of contact 35*a*, and the movable point of contact 22*b* is opened away from the fixed point of contact 35*b*. At this time, in cooperation with the movement of the movable insulation stand 20 at the left side the corresponding interlock lever 60 disposed at the left side is rotated in the clockwise direction from the lower position L to the upper position U through the passage 30*l* of the central partition wall 30*g* as shown with FIG. 8(*c*).

In this situation, if the coil 12 disposed at the right side of the common casing 30 is occasionally attempted to excite, upon the actuation of the movable insulation stand 20 at the right side the corresponding interlock lever 60 is rendered to rotate in the counter clockwise direction so as to force the lower end 60*c* of the interlock lever 60 to pass through the passage 30*l* of the central partition wall 30*g*, but the lower end 60*c* of the interlock lever 60 at the right side is forced to contact with the lower end 60*c* of the other interlock lever 60 at the left side being stationary at the upper position L through the passage 30*l* of the central partition wall 30*g* beforehand, resulting in that the interlock lever 60 at the right side is prohibited to rotate from the lower position L to the upper position U by the other operated interlock lever 60, and the movable insulation stand 20 at the right side is rendered not to actuate by any means, that is, being interlocked at the returned position. On the contrary thereto, when the coil 12 at the right side is excited, and the movable insulation stand 20 of the right side is actuated to rotate the corresponding interlock lever 60 to the upper position L passing through the passage 30*l* of the central partition wall 30*g*, the interlock lever 60 at the left side is forced not to rotate by the other operated interlock lever 60 of the right side, so that the interlock lever 60 of the left side is tentatively interlocked at the lower position L, as shown in FIG. 8(*b*). Accordingly, on the provision of the interlocking mechanism of the above construction, the alternative operations of the both contactors are ensured, that is, if and when either one of the contactors is excited to operate, the other of the contactors is interlocked not to operate even when the other one is rendered to excite. Also, in the interlocking mechanism, the interlock levers are adapted to engage at their upper ends into the engaging grooves provided on the movable insulation stands 20, the engagement between the interlock levers and the embracing members 24 of the movable insulation stands can be designed in a large dimension to have enough strength as well as in a simple construction to be easily assembled into the interlocking mechanism.

If the excitation of the coil 12 is removed, the movable insulation stand 20 is returned back to the initial state.

In the electromagnetic apparatus having the above-described construction, the matching of the suction force characteristics and the load of the electromagnetic device 10 is substantially dependent on the total spring force of the conical coil spring 27 and the operating spring 8. However, if the adjustment spring 9 is slid to change the effective distance of the leaf spring 9*a* which is to be in contact with the end face of the shaft supporting portion 2*b*, the matching can be adjusted.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. An electromagnetic apparatus combined with a at least a pair of contactors into one unit, comprising:

a casing having at least two compartments, wherein each compartment accommodates at least one of the pair of contactors, and wherein each of the pair of contactors opens and closes a fixed contact by means of a movable contact provided in a movable insulation stand through a movable polar member to be reciprocating in accordance with excitation and de-magnetization of an electromagnetic device, and wherein the movable insulation stand being provided with an embracing member having an engaging groove to be opened rightly to the direction of the movement thereof, and an interlocking mechanism provided on the casing with a pair of interlock levers, each of which has an end which is rotatably inserted into the engaging groove of the embracing member of the movable insulation stand, wherein the pair of interlock levers are arranged in order to interfere with each other so that the pair of contactors are adapted to operate one by one for prohibiting the simultaneous operations of the conductors.

2. The electromagnetic apparatus as defined in claim 1, wherein the end of each of the interlock lever to be inserted into the corresponding engaging groove of the embracing member is formed of a generally round shape which is slidable along the opposite surfaces of the groove faced to the opening.

3. The electromagnetic apparatus as defined in claim 2, wherein the embracing member having the groove portion is passed over the generally round shape portion of the interlock lever.

* * * * *